US009890776B2

(12) United States Patent
Graybill

(10) Patent No.: US 9,890,776 B2
(45) Date of Patent: Feb. 13, 2018

(54) SOLAR DRIVE CONTROL SYSTEM FOR OIL PUMP JACKS

(71) Applicant: Raptor Lift Solutions, LLC, Houston, TX (US)

(72) Inventor: Kavan Graybill, Leicester, NC (US)

(73) Assignee: Raptor Lift Solutions, LLC, Houston, TX (US)

( * ) Notice: Subject to any disclaimer, the term of this patent is extended or adjusted under 35 U.S.C. 154(b) by 0 days.

(21) Appl. No.: 15/456,796

(22) Filed: Mar. 13, 2017

(65) Prior Publication Data

US 2017/0335838 A1 Nov. 23, 2017

Related U.S. Application Data

(63) Continuation of application No. 14/208,299, filed on Mar. 13, 2014, now Pat. No. 9,617,990.

(60) Provisional application No. 61/852,540, filed on Mar. 18, 2013.

(51) Int. Cl.

| | |
|---|---|
| ***F04B 41/02*** | (2006.01) |
| ***F04B 17/00*** | (2006.01) |
| ***F04B 47/02*** | (2006.01) |
| ***F04B 17/02*** | (2006.01) |

(52) U.S. Cl.
CPC ..... *F04B 47/022* (2013.01); *F04B 17/006* (2013.01); *F04B 17/02* (2013.01)

(58) Field of Classification Search
CPC ..... F04B 17/006; F04B 17/02; F04B 47/022
USPC ..... 60/641.8, 641.1, 667
See application file for complete search history.

(56) References Cited

U.S. PATENT DOCUMENTS

| | | | | |
|---|---|---|---|---|
| 5,409,356 | A * | 4/1995 | Massie | F04B 47/022 417/416 |
| 2005/0281680 | A1 | 12/2005 | Schulz | |
| 2008/0262857 | A1* | 10/2008 | Perera | G06Q 30/00 705/1.1 |
| 2010/0054959 | A1 | 3/2010 | Rogers et al. | |
| 2010/0143158 | A1* | 6/2010 | Alston | F04B 35/04 417/44.11 |
| 2012/0223584 | A1* | 9/2012 | Ledenev | H01L 31/02021 307/82 |
| 2013/0263613 | A1* | 10/2013 | Bittner | F25B 25/005 62/56 |

OTHER PUBLICATIONS

Rising oil prices have fueled advances in underground drilling but ground-level technologies have been stagnant for decades . . . Until Now. By Lozanova May/Jun. 2011.

* cited by examiner

*Primary Examiner* — Mark Laurenzi
*Assistant Examiner* — Dapinder Singh
(74) *Attorney, Agent, or Firm* — Baker & Hostetler LLP

(57) ABSTRACT

A system for supplementing the electric power needed by a pump jack electric motor, thereby reducing the electric power purchased from the local utility or power supplier. The system comprises a solar photovoltaic system, or other forms of renewable energy, and regenerated power from the electric motor or drive. The system can be both "on-grid" and "off-grid." Battery banks and capacitor banks may be used to store energy.

20 Claims, 3 Drawing Sheets

SOLAR DRIVE CONTROL SYSTEM FOR OIL PUMP JACKS

PRIORITY INFORMATION

The present application is a continuation application of U.S. application Ser. No. 14/208,299 filed Mar. 13, 2014 that, in turn, claims benefit of and priority to U.S. Provisional Application No. 61/852,540, filed Mar. 18, 2013, by Kavan Graybill, and is entitled to that filing date for priority. The specification, figures and complete disclosure of U.S. Provisional Application No. 61/852,540 and U.S. application Ser. No. 14/208,299 are incorporated herein by specific reference for all purposes.

FIELD OF THE INVENTION

This invention relates to a system for coordinating the use of solar energy and other forms of renewable energy with regenerated energy from oil pump jacks.

BACKGROUND OF THE INVENTION

A pump jack is a surface drive mechanism for a reciprocating piston pump in an oil well, and is used to mechanically lift oil or other liquids out of the well when there is insufficient subsurface pressure. Pump jacks are typically used onshore in relatively oil-rich areas. Modern pump jacks typically are powered by a electric motor, and the pump jack converts the motive force of the motor to a vertical reciprocating motion to drive the pump shaft (thereby causing a characteristic nodding motion). Electrical power usually is obtained from the electrical grid of the local electric utility or power supplier.

SUMMARY OF THE INVENTION

In various exemplary embodiments, the present invention comprises a system for supplementing the electric power needed by a pump jack electric motor, thereby reducing the electric power purchased from the local utility or power supplier. In one embodiment, the system comprises a solar photovoltaic system and regenerated power from the electric motor or drive. The system can be both "on-grid" and "off-grid."

In an "on-grid" embodiment, the system allows for a balanced connection between the utility power grid and a solar photovoltaic system through the DC buss of a regenerative variable frequency drive (VFD) or variable speed drive. In general, the power required to operate the pump jack motor or drive is provided by the solar photovoltaic system and by the energy from the regenerative action from the operation of the pump jack on the electric motor. Any additional power required to operate the pump jack motor may come from the utility power grid. Any excess power may be sold back to the local utility via a "net meter" agreement or similar arrangement.

The solar photovoltaic system may be connected directly to the common DC buss on the regenerative variable speed drive, which allows the regenerative drive to convert energy produced by the solar photovoltaic system (which is DC energy) to synchronized 3-phase waveforms. This is the utility-required format for energy passed from the system to the utility grid.

In several embodiments, the regenerative capabilities of the drive must meet or exceed all utility requirements for power filtering and harmonic issues that are required for direct connection of the drive to the utility with respect to the driver supplying power back to the utility. The regenerative drive must meet or exceed all utility requirements concerning direct interconnection guidelines for small generator interconnect agreements.

In an "off-grid" embodiment, the system captures and/or reuses the power generated from a solar photovoltaic array, an optional wind turbine or wind turbine array, as well as the regenerated power from the pump jack drive. Regenerative power from the pump jack drive may be stored in a 480 DC capacitor bank, and fed back into the DC buss of the variable frequency drive. The solar and wind energy may be stored in a 480 DC battery bank. Energy needed to run the pump jack motor is pulled from the capacitor bank, with additional energy as needed pulled from the battery bank. In another embodiment where the system is connected to the power grid as well, the power grid also may be a source of energy to make up any difference. The battery bank and capacitor bank are sized by the load needed to operate the respective pump jack drive or motor.

DETAILED DESCRIPTION OF EXEMPLARY EMBODIMENTS

In various exemplary embodiments, the present invention comprises a system for supplementing the electric power needed by a pump jack electric motor, thereby reducing the electric power purchased from the local utility or power supplier. In one embodiment, the system comprises a solar photovoltaic system and regenerated power from the electric motor or drive. The system can be both "on-grid" and "off-grid."

Figure 1:
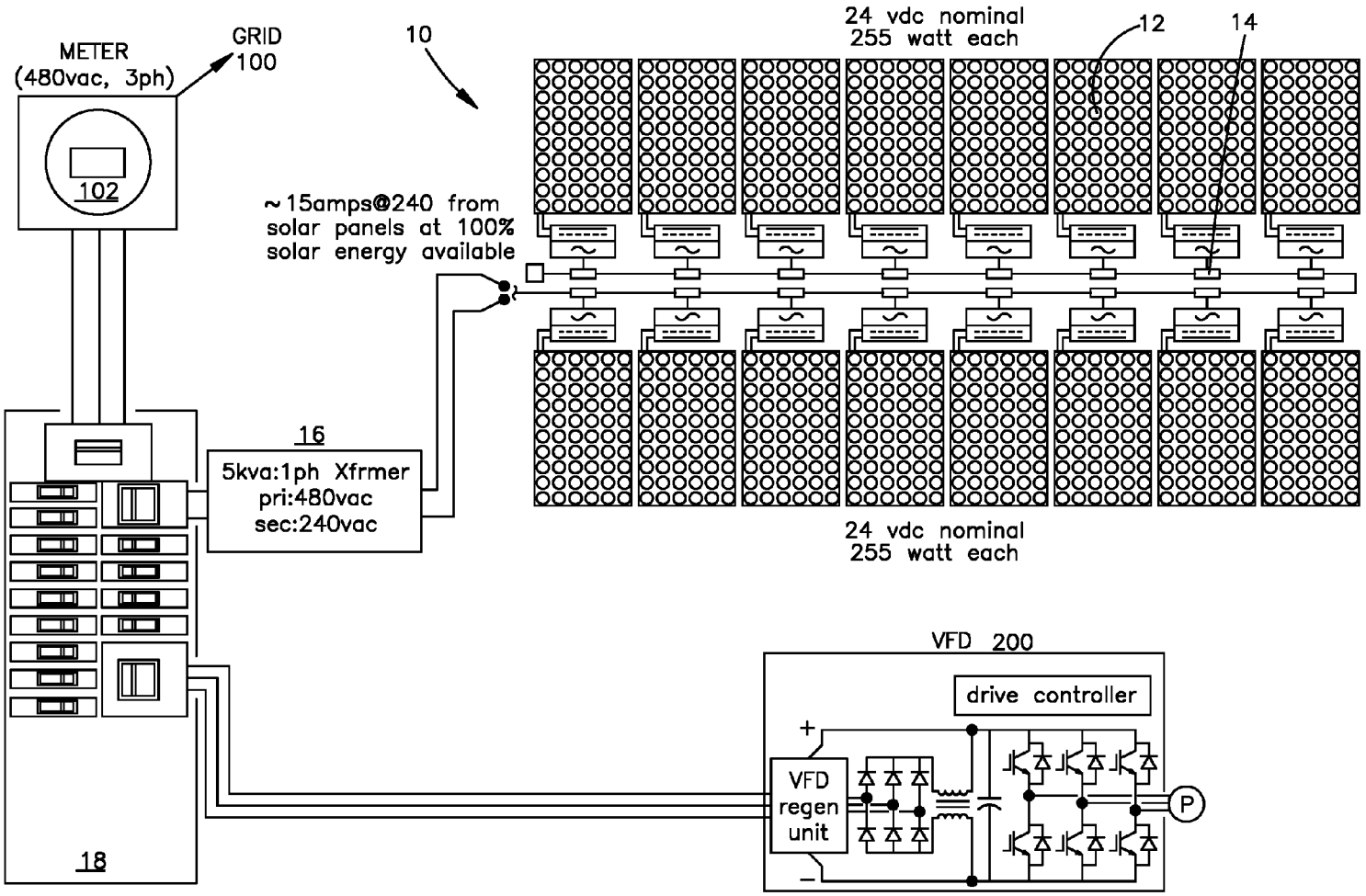
FIG. 1 shows a view of a system in accordance with an embodiment of the present invention.

In an "on-grid" embodiment, as seen in FIG. 1, the system allows for a balanced connection between the utility power grid 100 and a solar photovoltaic system 10 through the DC buss of a regenerative variable frequency drive (VFD), also referred to by several other terms, including, but not limited to, variable speed drive, variable speed controller, or similar terms 200. In general, the power required to operate the pump jack motor or drive is provided by the solar photovoltaic system 10 and by the energy from the regenerative action from the operation of the pump jack on the electric motor. Any additional power required to operate the pump jack motor may come from the utility power grid 100. Any excess power may be sold back to the local utility via a "net meter" agreement or similar arrangement.

As seen in FIG. 1, in one embodiment the solar photovoltaic system comprises an array of solar panels 12 (with kW output sized by load), connected through individual solar inverters 14 (which, in the embodiment shown, converts 24V DC to 240V AC) to a transformer 16, which in turn is connected to the power distribution box 18. In this embodiment, the transformer converts 240V AC to 480V AC single phase. The power distribution box is connected to the power grid 100 through a meter 102. The VFD with front-end regenerative unit controls the speed of the motor, and is grid tied to the invertor for the solar array system converting 480V AC single phase to 480V three phase. The regenerative unit may be integrated with the VFD, or may be a separate unit connected thereto.

Figure 2:
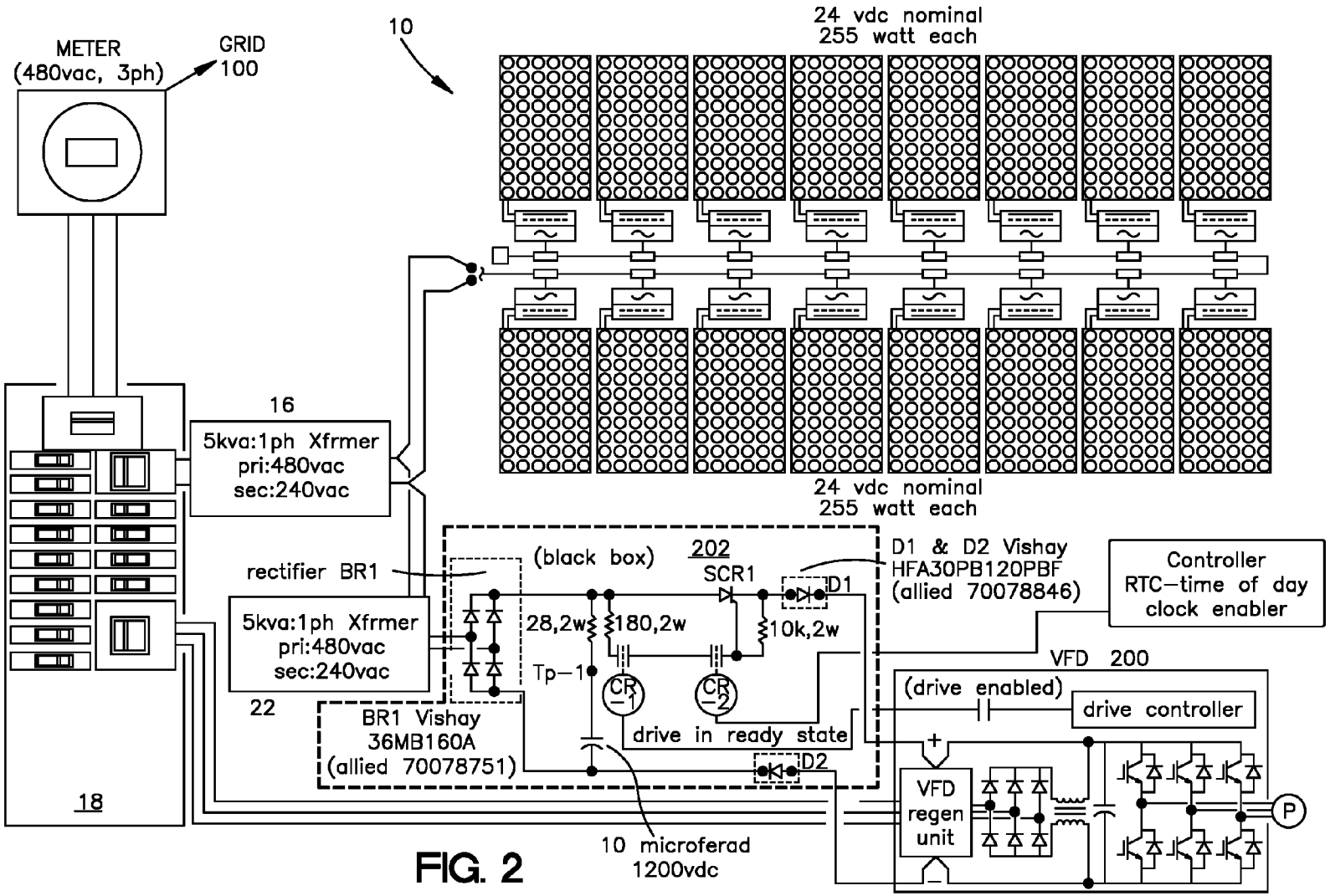
FIG. 2 shows a view of a system with direct connection between the solar array and the regenerative unit of the variable speed drive.

As seen in FIG. 2, the solar photovoltaic system 10 may be connected directly to the common DC buss on the regenerative VFD 200, which allows the regenerative drive to convert energy produced by the solar photovoltaic system (which is DC energy) to synchronized 3-phase waveforms. This is the utility-required format for energy passed from the system to the utility grid. In the embodiment shown, a second transformer 22 is added (in this embodiment, converting 240V AC to 480 V AC), and is connected to inverter 202, which inverts 480V AC single phase to 650V DC, thereby tying the energy from the solar panel array directly to the VFD 200.

In several embodiments, the regenerative capabilities of the drive must meet or exceed all utility requirements for power filtering and harmonic issues that are required for direct connection of the drive to the utility with respect to the driver supplying power back to the utility. The regenerative drive must meet or exceed all utility requirements concerning direct interconnection guidelines for small generator interconnect agreements. For both of the above examples, the parameters for the VFD may be adjusted to increase the amount of regenerated energy and optimize the power usage of the pump jack.

While the above discussion was in the context of solar power, other forms of renewable energy sources may be used, including, but not limited to, wind and hydro-electric. These may be used separately, or in combination.

Figure 3:
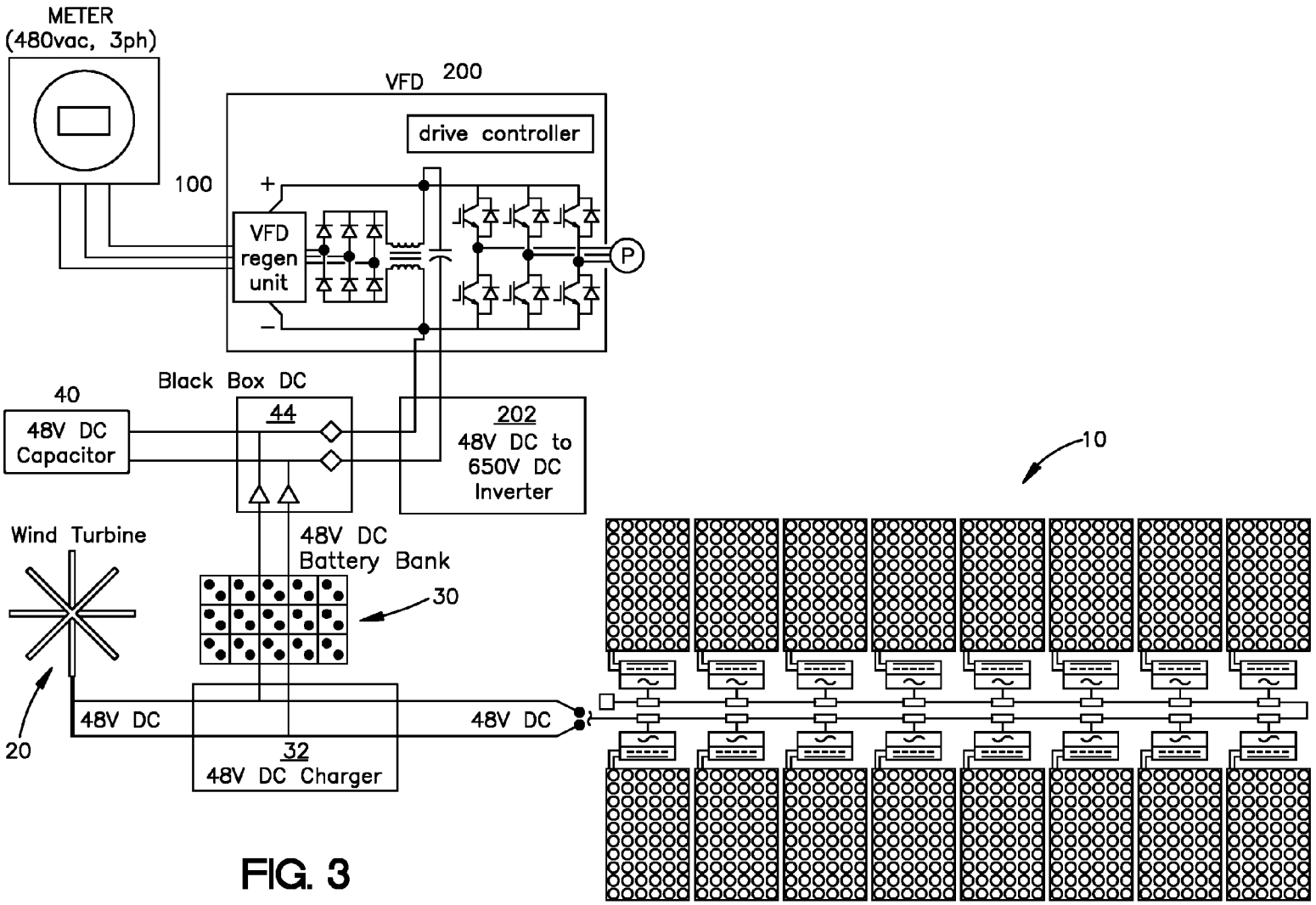
FIG. 3 shows a view of an "off-grid" system.

In an "off-grid" embodiment with combined renewable energy sources, as seen in FIG. 3, the system captures and/or reuses the power generated from a solar photovoltaic array 10, an optional wind turbine or wind turbine array 20, as well as the regenerated power from the pump jack drive. Regenerative power from the pump jack drive may be stored in a DC capacitor bank (in this example, 48V) 40, and fed back into the DC buss of the variable frequency drive 200. The solar and wind energy are directed through a DC battery charger 32 (with size determined by the amount of energy generated by the solar array and wind turbine; in this example, 48V DC), and may be stored in a DC battery bank (in this example, 48V DC) 30. In one embodiment, the batteries may be lithium ion or lead acid batteries, and sized based on expected loads.

The capacitor bank is the storage bank for regenerated power from the motor, and allows the regenerated power to be stored and reused. In one embodiment, the bank comprises nickel oxide hydroxide high amperage capacitors.

Energy needed to run the pump jack motor is pulled from the capacitor bank 40, with additional energy as needed pulled from the battery bank 30, through a DC interconnection box 44. The interconnection box allows for level flow of DC power back to the capacitor bank, but stopping any reverse flow to the battery bank. The interconnection box is connected to inverter 202, which inverts 480V AC single phase to 650V DC (as described above for the direct connection embodiment).

In another embodiment where the system is connected to the power grid as well, the power grid also may be a source of energy to make up any difference. The battery bank and capacitor bank are sized by the load needed to operate the respective pump jack drive or motor. The VFD 200 controls the speed of the motor, and acts as inverter for on-grid and off-grid configurations.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. An apparatus, comprising:

a variable frequency drive configured to generate energy from vertical reciprocating motion of a pump jack during normal operation of said pump jack, said variable frequency drive configured to couple to an electrical power grid, the variable frequency drive comprising a DC buss;

an electrical power storage bank outputting stored electrical power to the DC buss, wherein the variable frequency drive inverts the direct current received from the electrical power storage bank to alternative current, wherein at least a portion of the energy required to operate the pump jack to produce petroleum hydrocarbons is obtained from both the electrical power grid and the stored electrical power.

2. The apparatus of claim 1, wherein the electrical power storage bank comprises a DC capacitor bank.

3. The apparatus of claim 2, wherein the DC buss that is coupled to the DC capacitor bank, and is further configured to be coupled to the electrical power grid.

4. The apparatus of claim 3, wherein the variable frequency drive inverts direct current from the DC buss to alternating current to operate the pump jack.

5. The apparatus of claim 1, further comprising a regeneration unit configured to generate energy from vertical reciprocating motion of the pump jack during normal operation of the pump jack, and apply the generated energy to the electrical power storage bank, such that the at least a portion of the energy required to operate the pump jack is further obtained from the regeneration unit.

6. The apparatus of claim 1, further comprising a renewable energy source configured to supply renewable electrical energy to the variable speed drive.

7. The apparatus of claim 6, wherein the renewable energy source comprises at least one of a photovoltaic array and a wind turbine.

8. The apparatus of claim 7, further comprising a battery bank configured to store from the renewable electrical energy, and output the renewable electrical energy to the DC buss.

9. The apparatus of claim 8, further comprising an inverter disposed between the battery bank and the DC buss, the inverter configured to receive the renewable electrical energy from the battery bank, invert the received renewable electrical energy to direct current, and apply the direct current to the DC buss.

10. An apparatus, comprising:

a regenerative variable frequency drive configured to generate energy from a vertical reciprocating motion device during normal operation of the device, said regenerative variable frequency drive comprising a DC buss that is configured to receive DC current, wherein the regenerative variable frequency drive is configured to couple to a first electrical power source such that the variable frequency drive draws electrical power from the first electrical power source, and at least a portion of the energy required to operate the device is obtained from the first electrical power source and the received DC current.

11. The apparatus of claim 10, further comprising a renewable energy source configured to supply renewable electrical energy to the DC buss.

12. The apparatus of claim 11, wherein the renewable energy source comprises a wind turbine.

13. The apparatus of claim 11, wherein the renewable energy source comprises a photovoltaic array.

14. The apparatus of claim 13, further comprising a battery bank configured to store from the renewable electrical energy, and output the renewable electrical energy to the DC buss.

15. The apparatus of claim 10, further comprising a battery pack configured to store energy and output the stored energy to the DC buss.

16. The apparatus of claim 10, wherein the reciprocal vertical motion device is a pump jack operable to produce petroleum hydrocarbons.

17. The apparatus of claim 10, wherein the first electrical power source comprises a utility power grid.

18. An apparatus, comprising:

a regenerative variable frequency drive configured to generate energy from vertical reciprocating motion of a pump jack during normal operation of said pump jack, said regenerative variable frequency drive comprising a DC buss;

a DC capacitor bank connected to the DC buss of the regenerative variable frequency drive through a DC interconnection box;

wherein at least a portion of the energy required to operate the pump jack to produce petroleum hydrocarbons is obtained from the generated energy from the vertical reciprocating motion of the pump jack and a first electrical power source, further wherein said generated energy is stored in and removed from the DC capacitor bank to the DC buss of the regenerative variable frequency drive through the DC interconnection box.

19. The apparatus of claim 18, wherein the first electrical power source is a utility power grid.

20. The apparatus of claim 19, wherein the apparatus is connected to a utility power grid through a meter.

* * * * *